US005526099A

United States Patent [19]

Katakabe

[11] Patent Number: 5,526,099

[45] Date of Patent: Jun. 11, 1996

[54] DEVELOPING DEVICE AND AN IMAGE FORMING APPARATUS USING THE SAME

[75] Inventor: Noboru Katakabe, Uji, Japan

[73] Assignee: Matsushita Electric Industrial Co., Ltd., Osaka, Japan

[21] Appl. No.: 376,080

[22] Filed: Jan. 20, 1995

Related U.S. Application Data

[63] Continuation of Ser. No. 161,768, Dec. 2, 1993, abandoned.

[51] Int. Cl.[6] ..... G03G 15/08

[52] U.S. Cl. ..... 355/245; 118/653

[58] Field of Search ..... 355/253, 251, 355/259, 260, 245; 118/653

[56] References Cited

U.S. PATENT DOCUMENTS

| | | | |
|---|---|---|---|
| 4,705,384 | 11/1987 | Mizutani et al. . | |
| 5,126,799 | 6/1992 | Matsuura et al. | 355/298 |
| 5,206,692 | 4/1993 | Ishida et al. | 355/260 |
| 5,260,750 | 11/1993 | Ishida et al. | 355/260 |
| 5,268,720 | 12/1993 | Saitoh | 355/246 |
| 5,289,241 | 2/1994 | Sugiyama et al. | 355/260 |
| 5,307,128 | 4/1994 | Murasaki et al. | 355/260 |

FOREIGN PATENT DOCUMENTS

| | | |
|---|---|---|
| 2013370 | 10/1990 | Canada . |
| 0331324 | 9/1989 | European Pat. Off. . |
| 0509441 | 10/1992 | European Pat. Off. . |
| 0568924 | 11/1993 | European Pat. Off. . |
| 1900803 | 8/1969 | Germany . |
| 2353229 | 4/1975 | Germany . |
| 4011073 | 10/1990 | Germany . |
| 60-176060 | 9/1985 | Japan . |
| 3-101784 | 4/1991 | Japan . |
| 3-282488 | 12/1991 | Japan . |
| 1252494 | 11/1971 | United Kingdom . |
| 1445024 | 8/1976 | United Kingdom . |

*Primary Examiner*—R. L. Moses
*Attorney, Agent, or Firm*—Ratner & Prestia

[57] ABSTRACT

A developing device according to the present invention is provided along a photosensitive body. The developing device comprises: a hopper for accommodating and supplying a developer; a recovering roller which serves as a developer carrier member for transporting the developer carried on a surface thereof to a developing place; and a developer circulating path for circulating the developer between the hopper and the recovering roller. The developer circulating path includes a part of the hopper and a forward path and a backward path both of which extend from the hopper along the photosensitive body, the forward path and the backward path respectively have spaces independent of each other, and in each of the spaces a screw is provided for holding the developer therein and transporting the developer.

12 Claims, 10 Drawing Sheets

DEVELOPING DEVICE AND AN IMAGE FORMING APPARATUS USING THE SAME

This application is a continuation of application Ser. No. 08/161,768 filed Dec. 2, 1993, now abandoned.

BACKGROUND OF THE INVENTION

1. Field of the Invention

The present invention relates to an electrophotographic image forming apparatus for use in a copying machine, a laser printer, or the like.

2. Description of the Related Art

A developing device or an image forming apparatus of this type is disclosed in Japanese Laid-Open Patent Publication No. 3-101784 and Japanese Laid-Open Patent Publication No. 3-282488.

FIG. 12 shows an image forming apparatus disclosed in Japanese Laid-Open Patent Publication No. 3-101784. As shown in FIG. 12, this image forming apparatus has a hopper 309 for accommodating a toner. The hopper 309 is positioned behind a developing sleeve 308 in the vicinity of a photosensitive body 301. The toner in the hopper 309 is starred by a toner stirrer 311 provided An the hopper 309, scraped up to a toner supply hole 309*a* disposed on the side of the developing sleeve 308, end supplied to the developing sleeve 308 via the toner supply hole 309*a*. The developing sleeve 308 carries a supplied toner on its surface. After the thickness of the toner is regulated by pressure of an elastic blade, the toner is opposed to the surface of the photosensitive body 301 which has been exposed to light, and an electrostatic latent image formed on the surface of the photosensitive body 301 is developed with the toner.

The hopper 309 for accommodating the developer occupies a large portion of the developing device 303. Therefore, the diameter of the developing device 303 can be shortened only to a limited extent. As a result, an image forming section becomes a large one, together with the above developing device 303 and other numerous image developing elements disposed around the hopper 309. This is disadvantageous in arranging a compact apparatus required especially for personal uses.

Further, an image developing unit pulled out of the main body is handled in various positions, such as the axial line of the developing sleeve 308 is turned vertically, or the upper portion of the developing device 303 is inclined transversally or downwards.

On the other hand, as an image forming apparatus with a more compact body is popularly produced, the apparatus is not necessarily used in one specified position. In such a case, the developing device 303 is turned in various directions as above.

If the direction of developing device 303 is different in individual uses or handling, the density of developer particles becomes uneven.

That is, the particles of the developer concentrate in the lower side by the gravity effect, if the axial line of the developing sleeve 308 inclines or turns vertically, because the developer can move freely in the hopper 309 and about the developing sleeve 308.

If this is caused by a temporary handling, it is required to set the developing device 303 in a proper position so as to perform a smoothing drive so that developer particles extend evenly. Accordingly, an operator has to wait for the elapse of a stand-by time period.

Additionally, in the case of selecting the direction of setting a main body for continuous use, the problem of uneven developer is not solved. The developing efficiency is unstable depending on the direction of setting, which results in a poorly developed image or failure of development in some cases.

FIG. 13 shows an image forming apparatus disclosed in the Japanese Laid-Open Patent Publication No. 3-282488. The image forming apparatus has a circulating transporting path for transporting circularly the developer, behind a developing sleeve 402. The circulating transporting path comprises a developer transporting path 408 and a developer transporting path 409. The developer transporting path 408 is disposed along the developing sleeve 402. A toner supply path 420 extending from a hopper 417 located in a rear portion is connected with a part of the developer transporting path 409. Additionally, a screw which can hold the developer well is adopted as a developer transporting body in the circulating transporting path for distributing the developer circularly.

However, a large space is opened about the developing sleeve 402 in a portion facing the developing sleeve 402 of the circulating transporting path. Accordingly, a large idle space is formed between the screw and the developing sleeve 402 of the developer transporting path 408, where the developer can move freely without being held by the screw or the developing sleeve 402. In such a space, the particles of developer concentrate in the lower side depending on the changes of position of developing device, resulting in a poorly developed image or a failure of development.

Further, the developer once supplied in the developer circulating path from the hopper 417 is continued to be transported in the developer transporting path until it is used for development. This makes a part of developer deteriorate suddenly, which makes a stable development impossible. Also, in the case where the amount of developer consummation in a developing place differs extremely in one developing operation from another, the developer clogs in the course of developer circulating path.

In addition, the developer is poured into the hopper 417 from a developer refill container when the developer in the hopper 417 is used up. In order to refill the hopper with developer to continue the operation, the developer refill container is attached to the hopper, or a mouth of the developer refill container is put over a developer supply opening of the hopper 417. In this case, a stable development is possible only when the supplied developer reaches uniformly in the whole range of a portion along the developing sleeve 402, while being transported gradually in the developer transporting path. Accordingly, it is arranged to perform an initializing operation for driving the developing device for a predetermined time period after the developer is supplied.

However, in the above conventional method, the time period is needed for the initializing operation in addition to supply of developer. It is inconvenient for the operator to wait for the start of the image forming operation for the predetermined time period after the supply of the developer.

SUMMARY OF THE INVENTION

According to one aspect of the invention, a developing device provided along a photosensitive body, includes: a hopper for accommodating and supplying a developer; a developer carrier member for transporting the developer carried on a surface thereof to a developing place; and a developer circulating path for circulating the developer between the hopper and the developer carrier member. The developer circulating path includes a part of the hopper and a forward path and a backward path both of which extend from the hopper along the photosensitive body, the forward path and the backward path respectively have spaces independent of each other, and in each of the spaces a developer transporting unit is provided for holding the developer therein and transporting the developer.

In one embodiment of the invention, a developer transporting ability for feeding the developer from the hopper to the forward path is larger than a developer transporting ability of the developer carrier member.

In another embodiment of the invention, each of the developer transporting unit includes a screw, and the screw located in the forward path extends in the hopper.

In still another embodiment of the invention, the developer transporting unit of the forward path does not reach a connecting portion for connecting one end of the forward path to one end of the backward path, and the developer transporting unit of the backward path reaches the connecting portion.

In still another embodiment of the invention, the developer includes a magnetic toner, the developing device further includes a magnetic field forming unit for forming a magnetic field between the developer circulating path and the developing place, and the magnetic field is strong enough to cause a magnetic force at least capable of holding the developer against the gravity.

In still another embodiment of the invention the magnetic field formed by the magnetic field forming unit reaches at least a space including the developer transporting unit on the side of the developer carrier member.

In still another embodiment of the invention, the magnetic field forming unit is a magnet for development located in the developer carrier member.

In still another embodiment of the invention, the hopper includes a refill port to which a developer refill container for refilling the developer into the hopper is attached, and a stirrer, located in the hopper, for stirring the developer in conjunction with the developer transporting unit; and the developing device includes a control circuit for controlling the stirrer to stir the developer in the hopper when the developer is refilled from the developer refill container, and for controlling the developer transporting unit to transport the developer in the developer circulating path to a developer supply opening through which the developer is supplied from the developer circulating path to the developer carrier member.

In still another embodiment of the invention the developer refill container includes: a stirring member therein; and a coupling portion for connecting a rotation axis of the stirring member and a rotation axis of the stirrer of the hopper to each other by attaching the developer refill container to the refill port and for disconnecting the rotation axis of the stirring member and the rotation axis of the stirrer of the hopper from each other by detaching the developer refill container from the refill port.

According to another aspect of the invention, an image forming apparatus includes: a photosensitive body on a surface of which an electrostatic latent image is formed; a developing device for developing the electrostatic latent image, including: a hopper for accommodating a developer and supplying the developer, located at one end of the photosensitive body in the longitudinal direction; a developer carrier member for transporting the developer carried on a surface thereof to a developing place; and a developer circulating path, including a part of the hopper, for circulating the developer between the hopper and the developing place; a cleaner for removing a residual developer from the surface of the photosensitive body, the cleaner being in contact with the surface of the photosensitive body; and a residual developer restoring unit for restoring the residual developer removed by the cleaner to the hopper.

According to still another aspect of the invention, an image forming apparatus includes: a photosensitive body on a surface of which an electrostatic latent image is formed; a developing device for developing the electrostatic latent image, including: a hopper for accommodating a developer and supplying the developer, located at one end of the photosensitive body in the longitudinal direction; and a developer circulating path, including a part of the hopper, for circulating the developer between the hopper and a part of the surface of the photosensitive body, the part of the surface functioning as a developer carrier member for transporting the developer carried on a surface thereof to a developing place; a cleaner for removing a residual developer from the surface of the photosensitive body, the cleaner being in contact with the surface of the photosensitive body; and a residual developer restoring unit for restoring the residual developer removed by the cleaner to the hopper.

In the developing device according to the present invention, the forward path and the backward path of the developer circulating path have respective spaces independent of each other. In each of the spaces a developer transporting unit is provided for holding the developer therein and transporting it. In this way, the particles of the developer in the developer transporting unit do not flow freely or gather unevenly, even if the device is inclined in various directions. So, the proper transportation of the developer to the developing place is maintained in this way. Also, the developer is returned to the hopper and released therein by the developer transporting unit at each time having completed one circulation. Accordingly, the developer does not clog in the course of circulation, without being affected by the variance of the amount of developer consumed in the developing place.

Further, in the idle surface between the developer circulating path and the developer carrier member, where the developer can not be held, the magnetic field is formed by the magnetic field forming unit so that the developer is held by magnetic force. Accordingly, even if the apparatus body is rocked or if the position of the body is changed, the developer does not gather in one side.

Also, the developer transporting unit is continuously operated in conjunction with the developer supply operation by the hopper till the developer supplied in the hopper reaches at least the developer supply opening. Accordingly, the developing operation can be started immediately after the developer is refilled.

Further, in the image forming apparatus of the present invention, the hopper is located at one end of the photosensitive body in the longitudinal direction, and the forward path and the backward path are located in parallel with and in contact with the photosensitive body. This arrangement makes it possible to make the apparatus body compact, and it is advantageous in that such a compact apparatus can be placed in various attitudes.

Moreover, in the image forming apparatus according to the present invention, the residual developer restoring unit is provided in the hopper. This residual developer restoring unit restores the residual developer collected by cleaning so as to reuse the developer. Accordingly, space for storing the recovered developer is not required.

Thus, the invention described herein makes possible the advantages of (1) providing a developing device and an image forming apparatus which are simply constructed and can be downsized easily, (2) providing a developing device and an image forming apparatus capable of performing stable image formation even immediately after the device body is inclined in various directions, (3) providing a developing device, in the case of making image forming elements like a photo-sensitive body and the developing device into a unit and making the unit detachable from the main body of the image forming apparatus, capable of performing proper image formation immediately after the unit is attached to the main body, irrespective of the attitude of the developing device outside the main body, (4) providing a developing device capable of performing development immediately after the developing device is refilled with a developer, and (5) providing a small-sized image forming apparatus having a simple structure and capable of recovering the developer remaining on a photosensitive body after transference and of reusing it.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the drawings.

EXAMPLE 1

Figure 1:
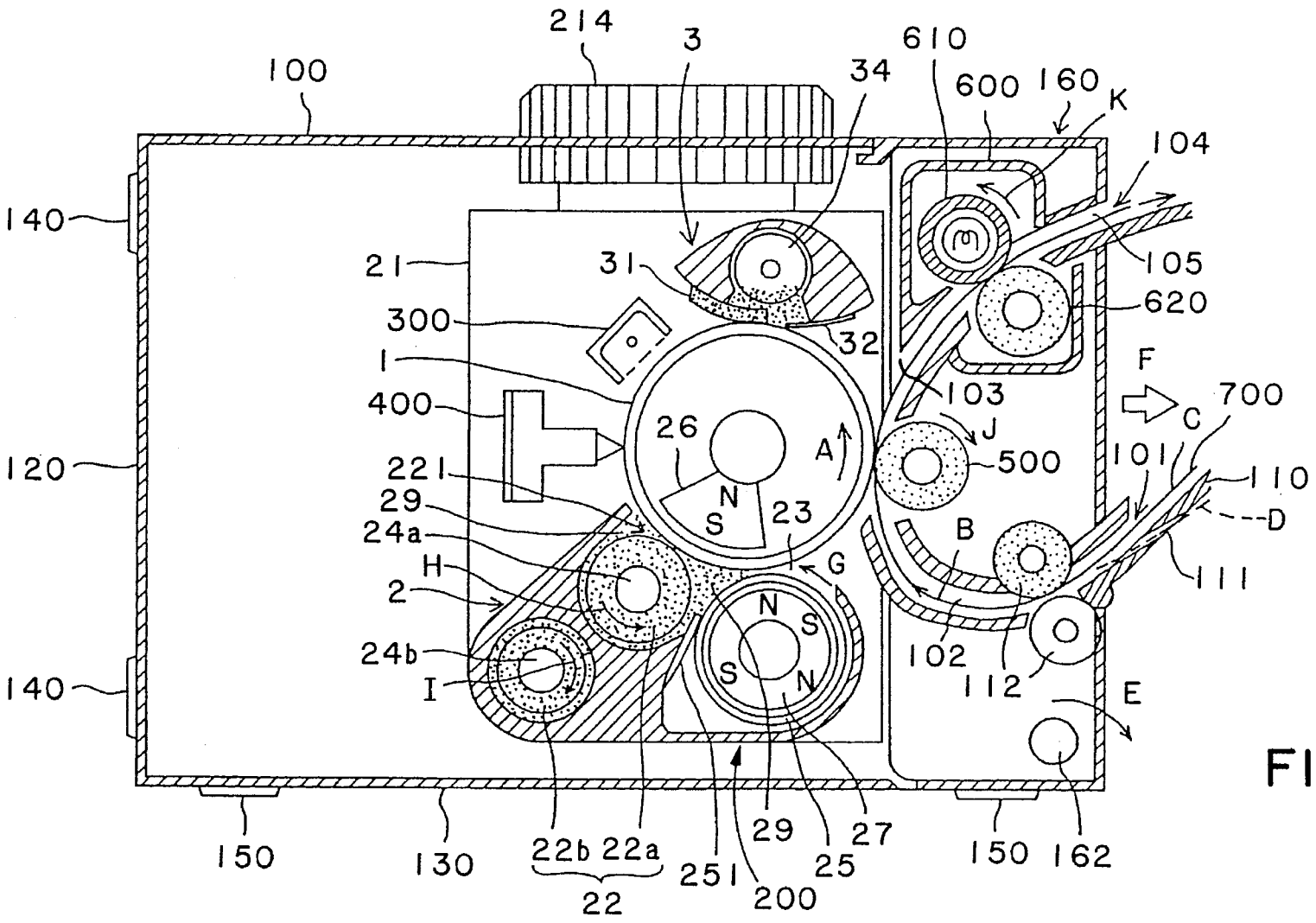
FIG. 1 is a cross-sectional view showing an image forming apparatus of Example 1 according to the present invention.
Figure 2:
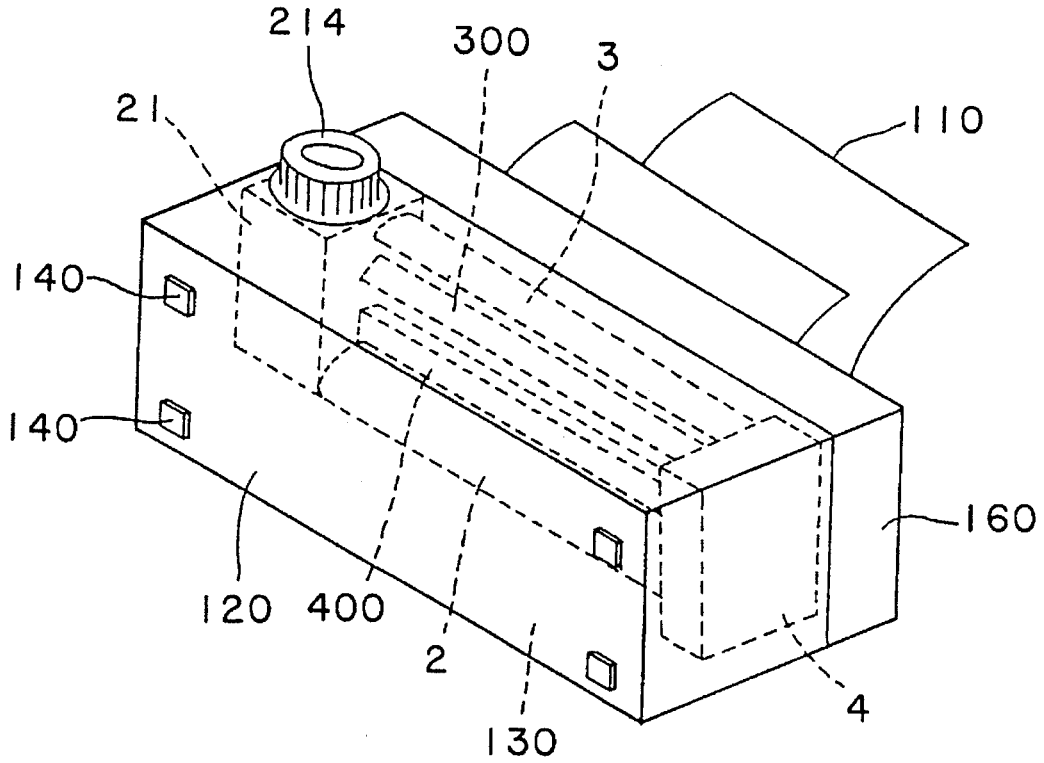
FIG. 2 is a perspective view of the image forming apparatus of Example 1.

The construction of an image forming apparatus of the present example will be described with reference to FIGS. 1 and 2. FIG. 1 is a cross-sectional view showing an image forming apparatus seen from the side, and FIG. 2 is a perspective view showing the same. A developing device according to the present invention is provided in a simple and compact image forming apparatus suitable for personal uses, which is especially connected to a personal computer.

As shown in FIGS. 1 and 2 this image forming apparatus has a case 100, an image forming unit 200, a charger 300, a printer head 400, a transfer roller 500, and a fixing device 600. The image forming unit 200 includes a photosensitive body 1, a developing device 2, 8 cleaner 3 and 8 drive mechanism 4. The photosensitive body 1 rotates in the direction of an arrow A. The charger 300, the printer head 400, the developing device 2, the transfer roller 500 and the cleaner 3 are disposed in this order around the circumference of the photosensitive body 1 in the direction of the arrow A.

Hereinafter, an operation of the image forming apparatus constructed as above will be described.

When an output command is given to the image forming apparatus, the drive mechanism 4 including a motor (not shown) starts a driving operation, and each of the components connected to the drive mechanism 4 operates. First, the photosensitive body 1 starts rotating in the direction shown by the arrow A. As soon as the photosensitive body 1 starts rotating, the charger 300 is turned ON to supply a predetermined amount of charge to the photosensitive body 1, and uniformly charges the photosensitive body 1 so that the surface potential thereof is approximately −550 V, for example.

When the charged surface of the photosensitive body 1 reaches the printer head 400, an image signal is supplied to the printer head 400. The charged surface is successively irradiated with light by the printer head 400 in accordance with the image signal. Thus, an electrostatic latent image is formed on the photosensitive body 1.

The electrostatic latent image formed on the photosensitive body 1 is developed by the developing device 2, whereby a developer image is formed on the photosensitive body 1. This developing operation will be described later in detail.

In this developing operation, a recording paper 700, sandwiched between the transfer roller 500 and the photosensitive body 1, is fed one after another. A bias voltage (e.g., approximately +1 kv) is applied to the transfer roller 500, and a negatively charged developer on the photosensitive body 1 is transferred onto the recording paper 700.

Then, the recording paper 700 on which the developer image is transferred passes through the fixing device 600, and the developer image is thermally fixed therein. Thereafter, the recording paper 700 is discharged from the image forming apparatus.

On the other hand, a part of a developer remaining on the photosensitive body 1 after the transfer operation is removed by the cleaner 3. The photosensitive body 1 thus cleaned returns to the charge position again, and is ready to repeat the above-mentioned operation again. After completing an image forming operation for one sheet of recording paper 700, the photosensitive body 1 stops. Further, according to the present example, the removed developer is collected and reused, as described later.

A construction and operation of each of the above-mentioned elements will be described in detail.

(Case 100)

At a position corresponding to a transfer section between the photosensitive body 1 and the transfer roller 500 on the external surface of the case 100, a paper supply slit 101 for manual feeding is disposed. The paper supply slit 101 has a paper guide 110 and a paper feeding rollers 112. The paper feeding rollers 112 rotates so as to send the recording paper 700 to the transfer section with a predetermined timing in a series of operations of the image forming apparatus as described above. Between the image forming unit 200 and the external surface of the case 100 having the paper supply slit 101, a paper feeding path 102 extending from the paper supply slit 101 is disposed. The recording paper 700, supplied from the paper supply slit 101, is transported to the transfer section via the paper feeding path 102, as shown by an arrow B. On the downstream side of the transportation of the recording paper 700 of the transfer section, a transporting path 103 for transporting the recording paper 700 from the transfer section to the fixing device 600 is disposed. On the external surface of the case 100, at a position corresponding to the fixing device 600, a paper discharge slit 104 is disposed. On the downstream side of the transportation of the recording paper 700 of the fixing device 600, a paper discharge path 105 for transporting the recording paper 700 from the fixing device 600 to the paper discharge slit 104 is disposed.

As shown in FIG. 2, the shape of the case 100 is substantially a rectangular parallelopiped and has six planes. According to the present invention, two planes can be selectively used for placing. That is, a plane 120 opposed to the plane on which the paper supply slit 101 is disposed and a plane 130, which is adjacent to the plane 120, among four planes surrounding an axis of the photosensitive body 1. According to the present invention, the paper supply slit 101 is disposed on the side of the plane opposed to the plane 120 so as to be close to the plane 130, and the paper discharge slit 104 is disposed on the plane opposite to the plane 120 so as to be away from the plane 130. In this way, the recording paper 700 can be easily discharged irrespective of whether the plane 120 or 130 is made a placing plane.

The paper guide 110 has a slit 111 extending in parallel with an axial direction of the photosensitive body 1. This makes it possible to supply and discharge the recording paper 700, irrespective of whether the plane 120 or 130 is selected as a placing plane. In the case where the plane 120 is selected, the recording paper 700 is guided and fed in the direction shown by the solid line C. In the case where the plane 130 is selected, the recording paper 700 is guided and fed through the slit 111 in the direction shown by the broken line D.

The planes 120 and 130 respectively have projections at corners thereof. Because of this, the image forming apparatus is stably placed. These projections 140 and 150 are preferably made of rubber or the like, for preventing slip.

An open-and-close section 160 (upper right portion in FIG. 1 has a paper feeding section including the paper feeding path 102, the paper transporting path 103, and the paper discharge path 105 and the like, in addition to the transfer roller 500, and the fixing device 600. This open-and-close section can be opened for removing Jammed paper, repairing the apparatus in the event of a failure and the like. The open-and-close section 160 is rotatable in the direction of an arrow E around a shaft 162 extending in parallel with the axial direction of the photosensitive body 1. Thus, the right hand side of the image forming unit 200 shown in FIG. 1 (i.e., the open-and-close section 160) is completely released therefrom, and the image forming unit 200 can be detached in the direction of an arrow F through the opening formed by this release. The detaching direction is freely set, depending on the arrangement of other elements and the open-and-close structure of each section of the case 100.

(Image forming unit 200)

(1) Photosensitive body 1

A conventional photosensitive body is used in the present invention. However, there is no particular restriction in the type of the photosensitive body 1.

(2) Developing device 2

The construction of the developing device 2 will be described with reference to FIGS. 3 to 9.

Figure 3:
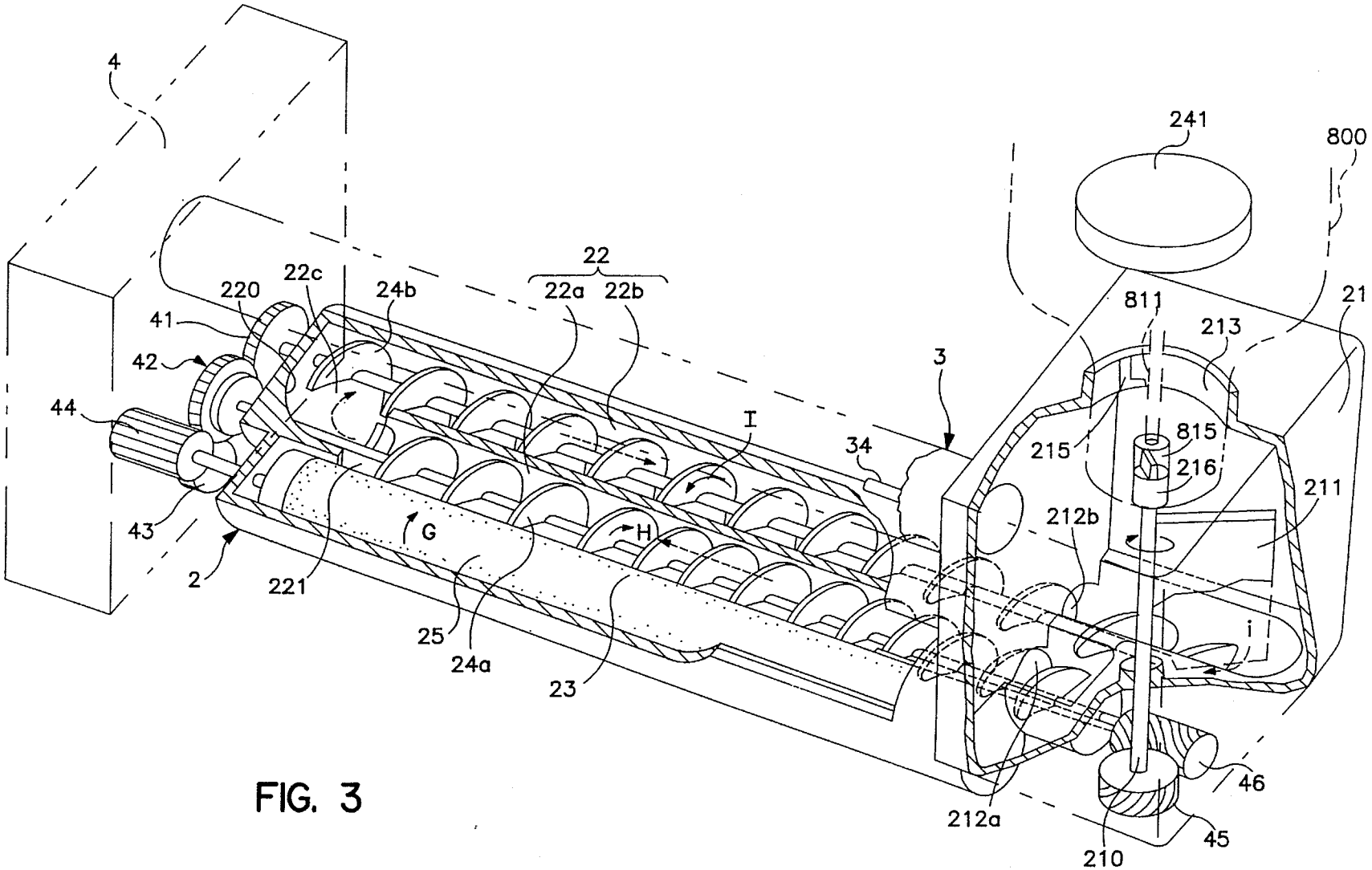
FIG. 3 is a partially cutaway perspective view of a developing device according to the present invention.
Figure 4A:
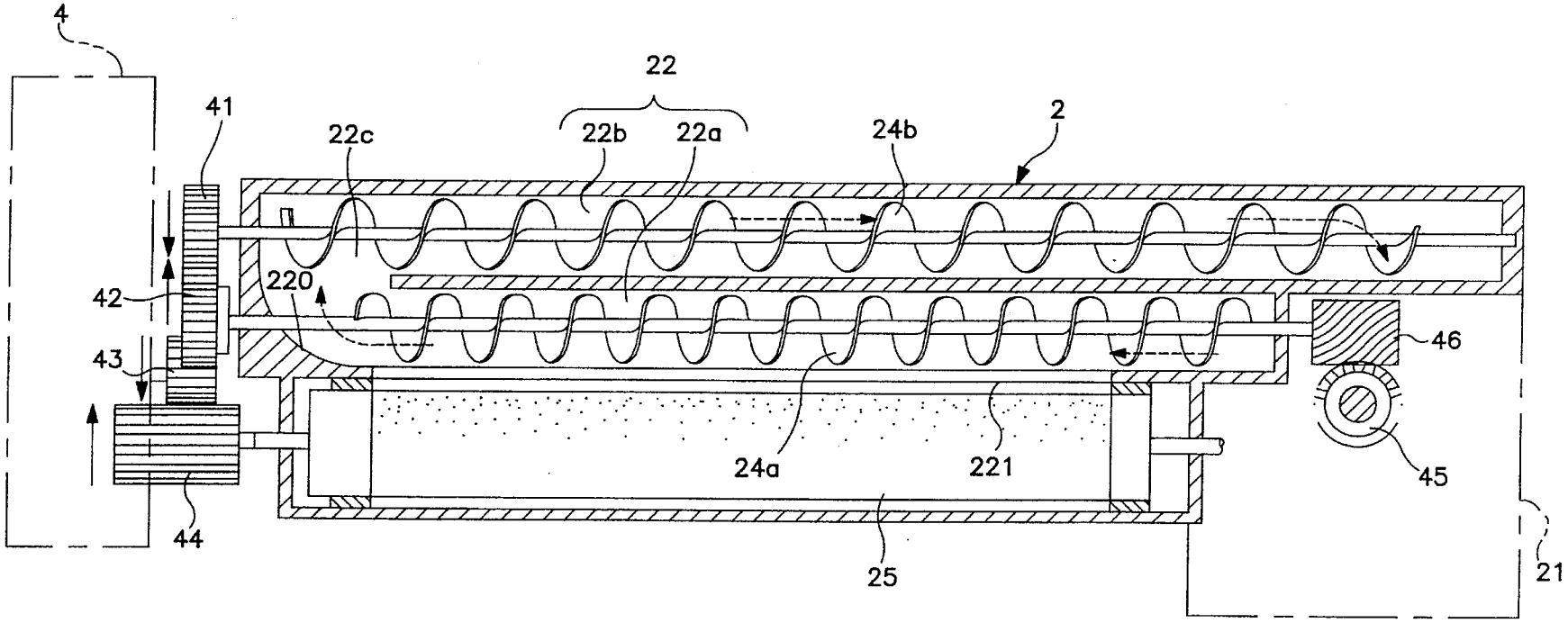
FIG. 4A is a cross sectional view of a developing device shown in FIG. 3 seen from above.

FIG. 3 is a partially cutaway perspective view of the developing device 2, and FIG. 4A is a cross-sectional view of the same seen from above. As shown in these figures, the developing device 2 has a hopper 21, a developer transporting pipe 22, and a recovering roller 25. The hopper 21 accommodates and supplies the developer. The developer transporting pipe 22 for transporting the developer supplied from the hopper 21. The recovering roller 25 forms a developer image by recovering the extra particles of developer.

The outline of a developing operation in the developing device 2 having the above-mentioned structure will be described.

The developer used for development is transported from the hopper 21 to the surface of the photosensitive body 1 through the developer transporting pipe 22 and arbitrarily supplied both to an image area and a non-image area on the photosensitive body 1. The developer supplied to the photosensitive body 1 is kept in a developing place 23, a portion between the photosensitive body 1 and the recovering roller 25. At the developing place, an AC electric: field is formed in addition to a DC electric field. Because of this, the developer supplied to the non-image area and the extra part of developer supplied to the image area are recovered by the recovering roller 25. Thus, the proper amount of developer is adhered only to the image area, whereby development is performed.

Hereinafter, a structure and operation of each member of the developing device 2 Will be described.

(A) Hopper 21

Figure 5:
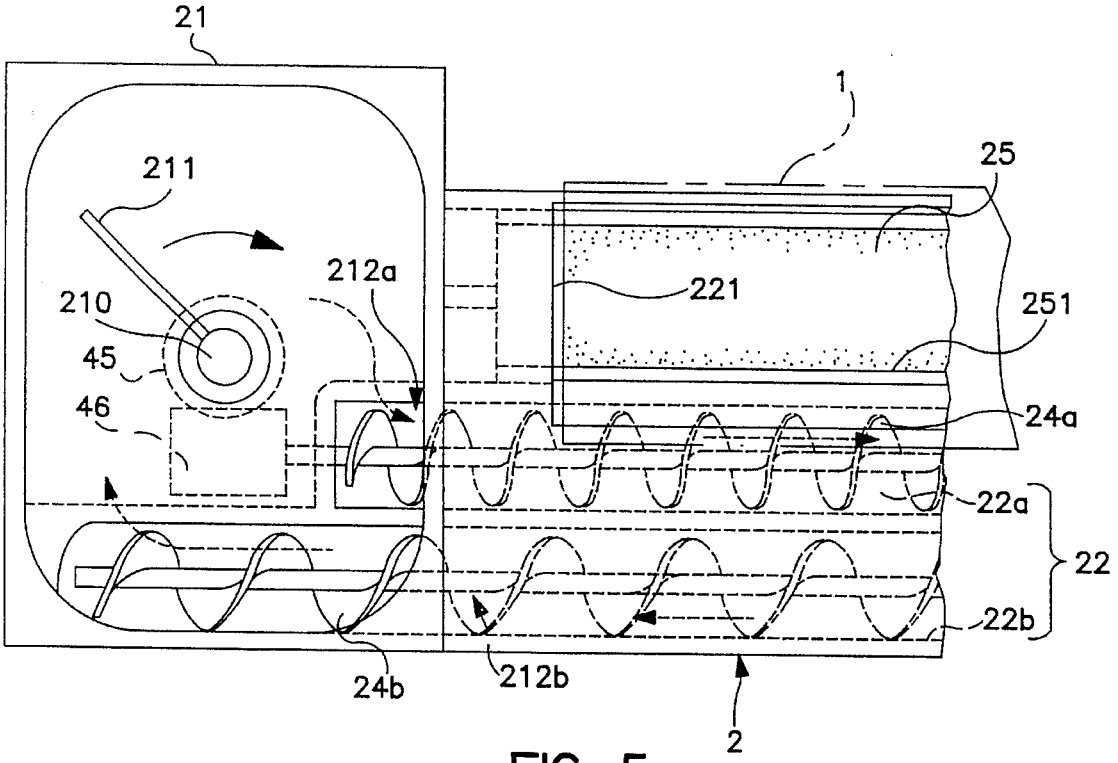
FIG. 5 is a top plan view showing a part of an image forming apparatus of FIG. 3 on the hopper side.
Figure 6:
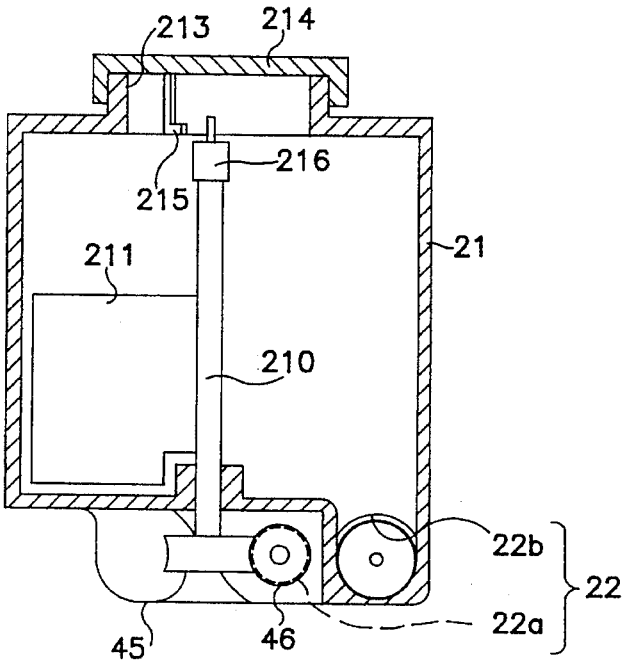
FIG. 6 is a longitudinal sectional view of a hopper of the image forming apparatus of FIG. 3.
Figure 7:
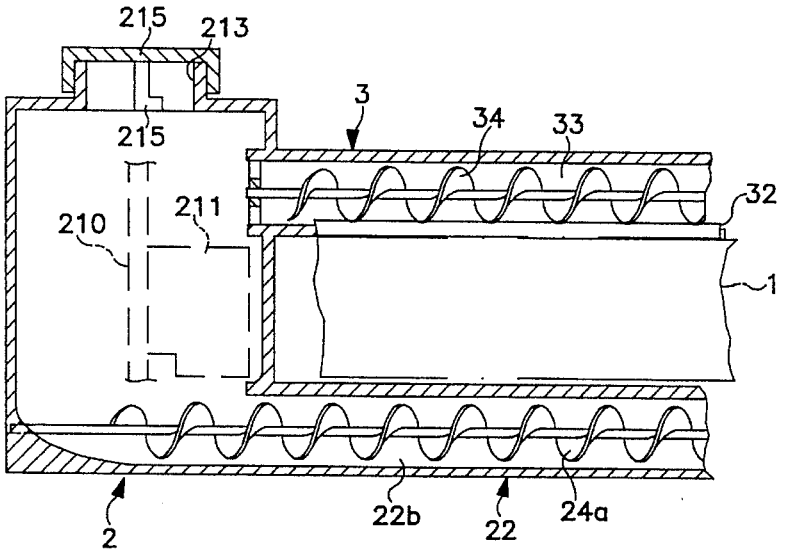
FIG. 7 is a longitudinal sectional view of a part of the image forming apparatus of FIG. 3 seen from the front.

FIG. 5 shows an enlarged view of the hopper 21 and its vicinity. FIG. 6 is a longitudinal sectional view of the hopper 21 seen from the side. FIG. 7 is a longitudinal sectional view of the hopper 21 portion, including the cleaner 3, seen from the front.

As shown in these figures, the hopper 21 is arranged outside of the edge in the longitudinal direction of the photosensitive body 1. The hopper 21 has a developer refill port 213 in its upper portion, through which the developer is supplied into the hopper 21. On the internal side plane of the developer refill port 213, a fit groove 215 in the shape of key is provided. In the hopper 21, a stirring blade 211 which rotates around a rotation shaft 210 vertically extending is disposed. The rotation shaft 210 extends towards the lower outside of the hopper 21. A gear 45 is disposed on the bottom edge of the rotation shaft 210, and a coupling 216 is disposed on the top edge thereof. Over the developer refill port 213, a cover 214 is disposed. As shown in FIG. 5, the hopper 21 has a developer outlet 212*a* for supplying the developer to the developer transporting pipe 22, and a developer inlet 212*b* for receiving the developer returning to the hopper 21 from the developer transporting pipe 22 without being used for development.

(Developer refill container 800)

Figure 8A:
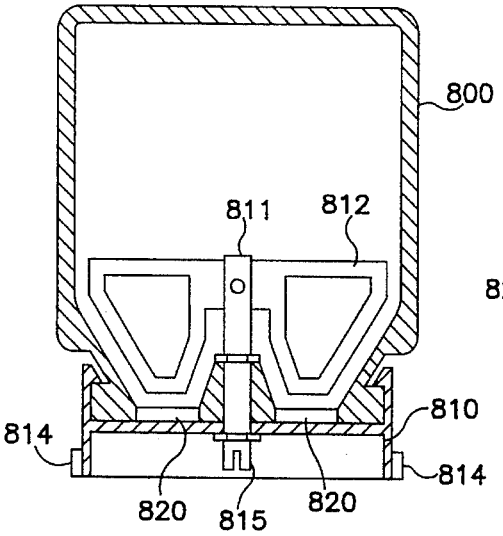
FIG. 8A is a cross-sectional view showing a developer refill container.
Figure 8B:
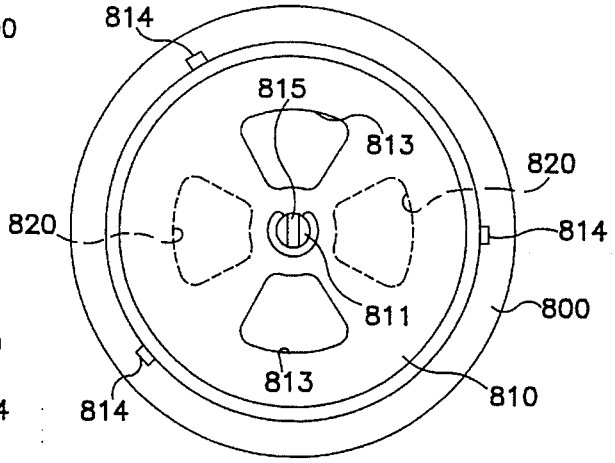
FIG. 8B is a top plan view showing the developer refill container.

A developer refill container 800 shown in FIG. 8A is used for refilling the developer in the hopper 21. The developer refill container 800 has a cylindrical shape. On the bottom thereof, two developer discharge outlets 820 are disposed in the circumferential direction as shown in FIG. 8B. Further, the developer refill container 800 has a cap 810 on its bottom, whereby these developer discharge outlets 820 are covered. The cap 810 has a stirring blade 812 rotatable around a rotation shaft 811 in the developer refill container 800, and the cap 810 itself is rotatable around the rotation shaft 811. The cap 810 has openings 813 corresponding to the developer discharge outlets 820. When these openings 813 fit in the developer discharge outlets 820, the developer in the developer refill container 800 can be discharged. On the outside of the cap 810, a coupling 815 connected to the rotation shaft 811 is provided, and projections 814 are formed on the periphery of the cap 810.

The hopper 21 has a developer refill container detecting sensor (not shown in FIG. 8A) for detecting that the developer refill container 800 is attached to the hopper 21. Various kinds of sensors such as a photosensor and a limit switch are usable for this developer refill container detecting sensor, which makes it possible to detect the attachment of the developer refill container 800 to the hopper 21, optically, electrically or mechanically.

Next, an operation of the developer refill container 800 will be described.

As shown in FIG. 3, at the time of refilling developer, the cover 214 is removed from the developer refill port 213, and the developer refill container 800 is attached to the developer refill port 213, whereby the developer is refilled in the hopper 21. In the attachment of the developer refill container 800, after the projections 814 of the developer refill container 800 is fit into the fit groove 215 of the hopper 21, the developer refill container 800 is fully pushed and revolved. Since the cap 810 is fixed, the cap 810 rotates with respect to the developer refill container 800, whereby the openings 813 of the cap 810 are aligned with the developer discharge outlets 820. In this way, the developer in the developer refill container 800 falls into the hopper 21 through the developer discharge outlets 820 and openings 813.

The coupling 815 on the rotation shaft 811 of the developer refill container 800 is automatically connected to the coupling 216 on the rotation shaft 210 of the hopper 21. Thus, the stirring blade 812 in the developer refill container 800 is driven for rotation in association with the rotation of the stirring blade 211 in the hopper 21. By the rotation of the stirring blade 812, the developer is smoothly moved from the developer refill container 800 to the hopper 21. This makes the time required for refilling the developer shorter. As a result, the standby time for image forming is shortened.

Further, since the stirring blade 812 and the stirring blade 211 in the hopper 21 are simultaneously driven, the developer can be successively supplied to the hopper 21 and then transported to the developing place 23. That is, the developer supplied to the hopper 21 is stirred and spread evenly by the stirring blade 211. This stirred developer is smoothly fed out into the developer transporting pipe 22 by means of a screw 24*a* disposed in a forward path 22*a* extending into the hopper 21. In this way, the developer is stably transported. Since the supply and transportation of the developer are completed in a short period of time, it is possible to stably supply the developer to the developing place 23 for development without an initializing operation after the supply of the developer or standby time required for this operation. Accordingly, there is an advantage that the image forming operation can be started immediately after the developer is supplied.

(B) Developer transporting pipe 22

As shown in FIG. 3, the developer transporting pipe 22 has the forward path 22*a* for forwarding the developer from the hopper 21, a backward path 22*b* for backwarding the developer once fed into this forward path 22*a*, and a connecting path 22*c* for connecting a first end of the forward path 22*a* and a first end of the backward path 22*b*. The forward path 22*a* and the backward path 22*b* extend in parallel with the axial direction of the photosensitive body 1. The forward path 22*a* and the backward path 22*b* respectively have spaces independent of each other, and respectively extend from the hopper 21 in parallel with the axial direction of the photosensitive body 1. A second end of the forward path 22*a* is connected to the developer outlet 212*a* of the hopper 21, and a second end of the backward path 22*b* is connected to the developer inlet 212*b* of the hopper 21. In this way, the forward path 22*a*, the backward path 22*b*, and the connecting path 22*c* form a continuous path for circulating the developer, including the hopper 21 as a part thereof. Since the developer transporting pipe 22 forms a closed space together with the photosensitive body 1 and the recovering roller 25, any particles of the developer does not scatter out of the closed space. The photosensitive body 1 functions as a developer carrier body for transporting the developer to the developing place 23.

The forward path 22*a* has a developer supply opening 221 in a position opposed to the photosensitive body 1, for supplying the developer directly to the surface of the photosensitive body 1. The developer supply opening 221 is large enough for the developer in a sufficient amount to be adhered both to an image area and a non-image area on the photosensitive body 1.

Figure 9:
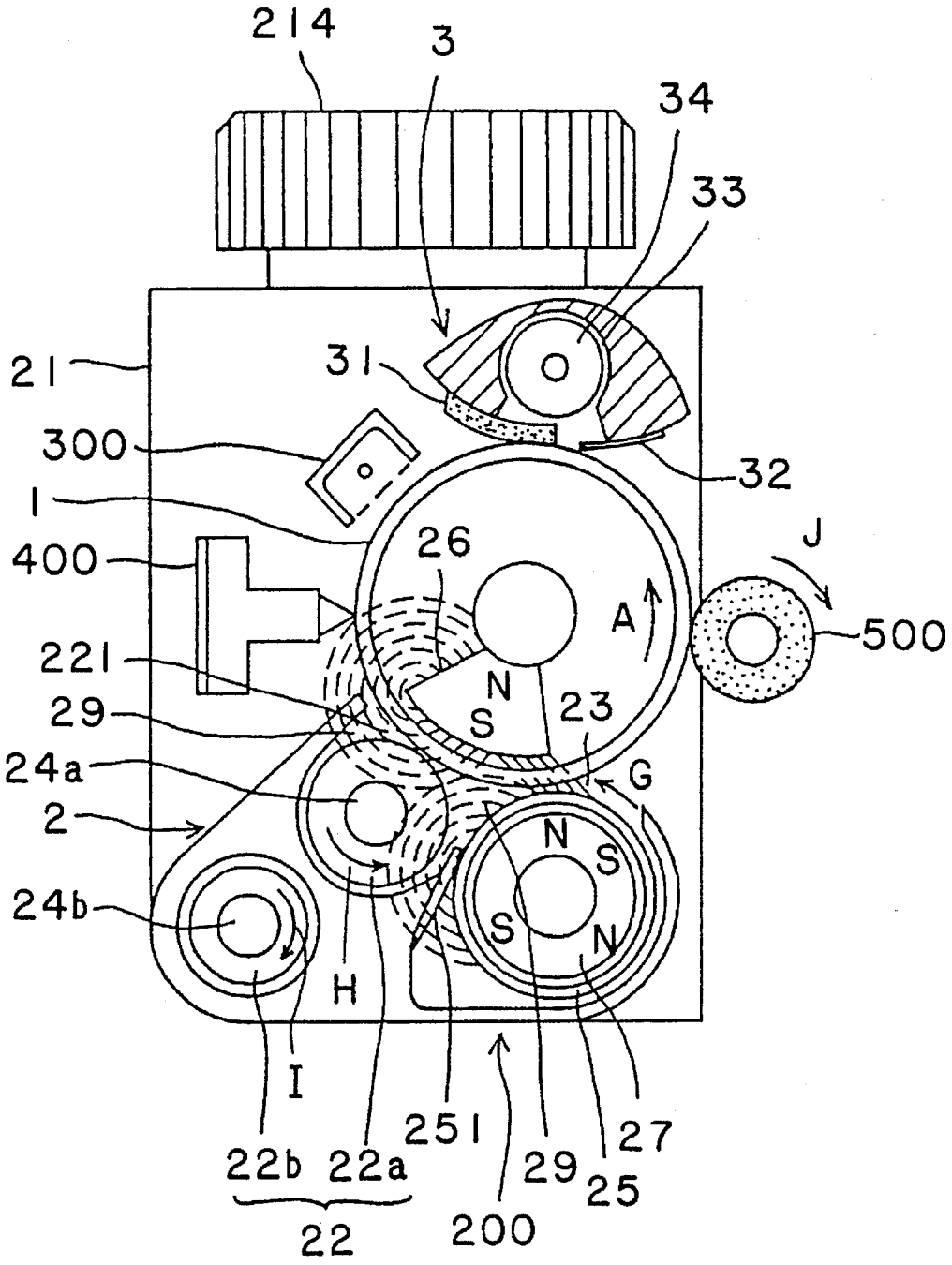
FIG. 9 is a cross-sectional view of an image forming unit of the image forming apparatus of FIG. 1.

As shown in FIGS. 1 and 9, the forward path 22*a* and the developer supply opening 221 are both provided beneath the photosensitive body 1 at an angle of about 45 degrees from the horizontal plane of the photosensitive body 1. Due to this arrangement, the developer supplying condition remains almost the same, irrespective of whether the apparatus is placed on the plane 120 or on the plane 130 of the case 100. Further, since the developer is always supplied to the photosensitive body 1 from below, whichever plane (i.e., the plane 120 or 130) is selected for placing, the excess supply of the developer caused by gravity can be prevented. Also, it avoids clogging the space with the particles of developer and thus applying extreme pressure to the developer.

Further, it is possible to effectively supply the developer by utilizing the force of a magnetic field. FIG. 9 is an enlarged longitudinal cross-sectional view of the developing device 2 and the vicinity thereof. As shown in FIG. 9, a sector-shaped magnet 26 is provided in the photosensitive body 1. A magnetic field as shown by broken lines in FIG. 9 is formed by means of the magnet 26 and a cylindrical magnet 27 (described later) located in the recovering roller 25. The developer transported in the forward path 22*a* is attracted and adhered to the surface of the photosensitive body 1, by a magnetic force of the magnetic field of the magnet 26. In the present example, a magnetic monocomponent developer is used.

A screw 24*a* and a screw 24*b* are provided in the forward path 22*a* and the backward path 22*b*, respectively. The screws 24*a* and 24*b* have a lead in the same direction with each other. The inner wall of the paths 22*a* and 22*b* are adjacent to the periphery of the screws 24*a* and 24*b*, respectively. Thus, it is possible to hold the particles of the developer in the spaces around the blades of the screws 24*a* and 24*b* against the influence of gravity, even when the developing device 2 is pulled out from the case 100, or when the direction of operation or placement is changed. Accordingly, the developer is prevented from gathering in either end of the developer transporting pipe 22, or in either side of the forward path 22*a* or the backward path 22*b*.

In the above-mentioned closed space, there is a developer idle space 29 free from the transporting force of the screw 24*a*. The developer idle space 29 is formed among the screw 24*a* in the forward path 22*a*, the photosensitive body 1 and the recovering roller 25. In the developer idle space 29, the developer is likely to flow without being caught therein, because it is free from the transporting force of the screw 24*a* or the carrying force of the photosensitive body 1 and the recovering roller 25. In the present example, however, a magnetic field formed between the magnet 26 in the photosensitive body 1 and the magnet 27 in the recovering roller 25 is formed in this developer idle space 29, and the strength of the magnetic field is set to a magnetic force strong enough to hold the developer against gravity. Therefore, the above-mentioned gathering of the developer is reliably prevented, even if the direction of the apparatus is variously changed. It is also possible to dispose a magnet in the vicinity of the developer transporting pipe 22 in addition to the magnets 26 and 27 to form the magnetic field, which has the developer caught in the developer idle space 29.

Also, by forming the magnetic field, which is caused by the magnets 26 and 27, in the screws 24*a* and 24*b*, the developer is caught more reliably by the screws 24*a* and 24*b*. In order to form such a magnetic field, the magnets 26 and 27 may be strengthen, or another magnet may be provided.

As shown in FIG. 4A, a guide plane 220 (a sidewall having a slope) is provided at the first end of the forward path 22*a*. This improves the transportation of the developer from the forward path 22*a* to the backward path 22*b*.

Also, as shown in FIG. 4A, the width of the connecting path 22*c* connecting the forward path 22*a* and the backward path 22*b* is made larger than that of the forward path 22*e*, and the screw 24*a* is not provided in this portion. Accordingly, the developer transported to the first end of the forward path 22*a* by the screw 24*a* is pushed to the side of the backward path 22*b*, and the pushed developer is caught by the screw 24*b* and forwarded into the backward path 22*b*. In the present example, since a part of the screw 24*a* is removed et the first end of the forward path 22*a* where a part of the wall separating the forward path 22*a* from the backward path 22*b* is removed, and the connecting path 22*c* is widened therein, the developer forwarded to this place is smoothly delivered to the adjacent backward path 22*b*. Thus, the transporting direction of the developer is reliably changed within a narrow space. If the screw 24*e* extends further closer to the guide plane 220, the developer is compressed to the side wall before being delivered to the backward path 22*b*, causing the developer to clog.

In the present example, the leads of the screws 24*a* and 24*b* are gradually enlarged so as to be larger at downstream than at upstream. As a result, even in the case where the screws 24*a* and 24*b* are rotated at a constant speed, the developer transporting ability is appropriately made larger whale being transported from the developer outlet 212*a* of the hopper 21, via the forward path 22*a* and the backward path 22*b*, to the developer inlet 212*b* of the hopper 21. That is, the developer receives more transporting force as it is traveling to the downstream, and finally released from the force when it is fed into the hopper 21 having a large capacity. Accordingly, it is possible to prevent the developer from clogging in the course of transportation or from being degraded under extreme stress due to high density similar to the clogging state. However, the lead of the screw 24*a* is constant in a position corresponding to the developer supply opening 221. If the lead is not constant, the amount of the developer supplied to the photosensitive body 1 varies in the axial direction of the photosensitive body 1, due to the difference in the transporting speed of the developer.

If the leads of the screws 24*a* and 24*b* are large, the force of holding the developer is weak. Accordingly, the developer is not held sufficiently between the blades of the screw 24*a* and the screw 24*b*, and the above-mentioned effect of preventing the developer from gathering is reduced. Such a problem is solved by providing a number of blades.

The screw 24*a* in the forward path 22*a* is provided so that a part thereof extends in the hopper 21 at the developer outlet 212*a*. This makes it possible to conveniently catch the developer in the hopper 21 and forward it reliably. At the developer outlet 212*a* of the hopper 21, the developer transporting ability of the screw 24*a* is set so as to be larger than that of the photosensitive body 1 for transporting the developer to the developing place 23. The reason for this setting is as follows:

In general, the developer transporting ability of the photosensitive body 1 is set so as to be sufficient for forming a whole surface solid black image. However, there is a possibility that the shortage of the developer supply amount is caused in the case where the developer transported through the developer transporting pipe 22 is decreased in amount while such a solid black image is repeatedly formed. The above-mentioned setting can avoid this shortage. Thus, an image density is stably maintained to be constant.

The setting of the developer transporting ability of the screws 24*a* and 24*b* can also be appropriately adjusted by modifying the diameter or driving speed of the screws 24*a* and 24*b*, in addition to the above-mentioned configuration of the leads.

As for the arrangement of the forward path 22*a* and the backward path 22*b*, the forward path 22*a* is always located above the backward path 22*b*, irrespective of whether the plane 120 or the plane 130 is selected for placing. Accordingly, it is possible to use gravity for changing the direction of transporting the developer in the connecting path 22*c*, and there is an advantage in that the developer does not clog.

Figure 4B:
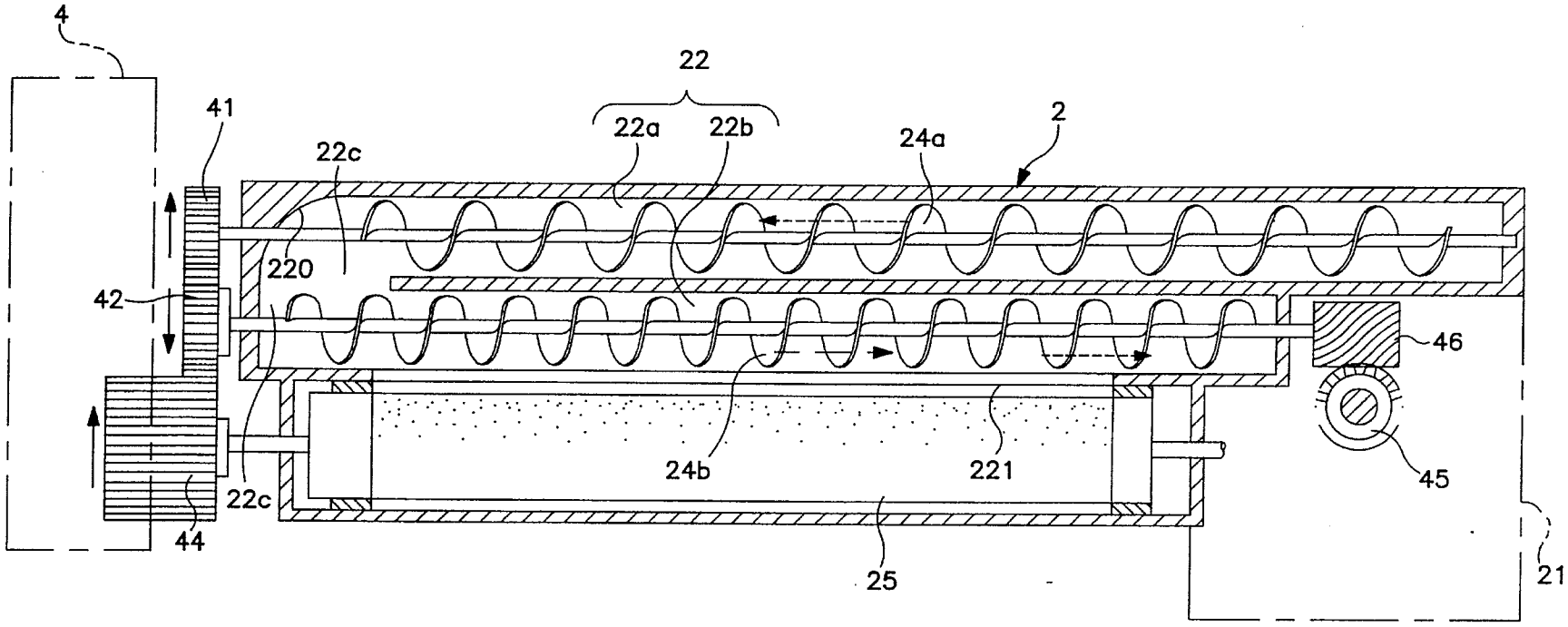
FIG. 4B is a cross sectional view of another developing device according to the present invention seen from above.

Alternatively, the forward path 22*a* and the backward path 22*b* can be transposed with each other as shown in FIG. 4B. In such an arrangement, the forward path 22*a* is always located below the backward path 22*b*, irrespective of whether the plane 120 or the plane 130 is selected for placing. Accordingly, it is possible to take the developer positioned at the bottom of the hopper 21 for development. Either the plane 120 or the plane 130 can be always used for placing.

The rotation direction of the screw 24*a* and the screw 24*b* is opposite to the rotation direction thereof shown in FIG. 4A. Accordingly, in the case shown in FIG. 4B, an idle gear 43 shown in FIG. 4A is unnecessary, and it is sufficient that the drive mechanism 4 directly drives a gear 44 by engaging a gear 42 connected to the screw 24*b* of the forward path 22*b* with a gear 44 connected to a rotation shaft of the recovering roller 25. As shown in FIG. 4B, the lead of the screws 24*a* and 24*b* is smaller on the side of forward path 22*a* and larger on the side of backward path 22*b*, and thereby the developer transporting ability is optimized. Also, the guide plane 220 is provided on the side of the forward path 22*a* in the connecting path 22*c*.

As described above, in the developing device 2 of the present example, the hopper 21 is located at the first end of the longitudinal direction of the photosensitive body 1, and the forward path 22*a* and the backward path 22*b* extend from the hopper 21 in parallel with the photosensitive body 1. Accordingly, only the forward path 22*a* and the backward path 22*b* are located around the periphery of the photosensitive body 1, and the hopper 21 is not located around the photosensitive body 1. Further, the forward path 22*a* and the backward path 22*b* are formed at a distance as short as possible for transporting the developer. Therefore, the space occupied by the developing device 2 around the periphery of the photosensitive body 1 is greatly reduced, thus miniaturizing the image forming apparatus.

(C) Recovering roller 25

A voltage is applied to the recovering roller 25 for forming the above-mentioned AC electric field with the DC electric field superimposed. In the present example, an AC voltage having a peak-to-peak voltage of 1.8 KV and a frequency of 1.5 kHz with a DC voltage of −300 V superimposed is supplied to the recovering roller 25, the surface potential of the photosensitive body 1 being approximately −550 V. Thus, the developer on a non-image area is effectively attracted to be removed by using an electric force obtained by functioning as an AC electric field in addition to a DC electric field between the photosensitive body 1 and the recovering roller 25. In the developer contacting the surface of the non-image area, the particles of the bottom part (i.e., the part which is directly in contact with the surface) are in a relatively stable condition. However:, the particles of the upper part of the developer are in a relatively free condition or in a completely free condition. Therefore, the developer can be removed from the non-image area by vibrating the particles of the upper part of the developer by the electric field, and then colliding the particles against the stabilized particles of the bottom part. In this way, the developer adhering to the non-image area can be effectively attracted to the side of the recovering roller 25 and removed.

For improving the efficiency of recovering unnecessary developer, it is possible to use a force by the magnetic field in addition to the above electric force. As described in the foregoing, the magnetic field as shown in FIG. 9 is formed by means of the magnet 26 in the photosensitive body 1 and the cylindrical magnet 27 in the recovering roller 25. The developer adhering to the non-image area can be effectively attracted to the side of the recovering roller 25 and removed by means of this magnetic field.

The developer on the recovering roller 25 thus removed from the non-image area is recovered in the forward path 22*a* by the rotation of the recovering roller 25. The recovering roller 25 rotates in the direction shown by an arrow G. A recovering blade 251 is located between the recovering roller 25 and the forward path 22*a*. The developer attracted by the recovering roller 25 is removed from the recovering roller 25 by the recovering blade 231. The recovering blade 251 also seals the space between the developer supply opening 221 and the recovering roller 25 so as to prevent the developer from flowing out from this space.

Hereinafter, an operation of the developing device 2 will be described.

Referring to FIGS. 3 and 4A, when the drive mechanism 4 starts driving, an idle gear 43 provided on the drive mechanism 4 rotates. As shown in these figures, the idle gear 43 is engaged with a gear 44 provided at one end of the shaft of the recovering roller 25. The shaft of the recovering roller 25 rotates in the direction shown by the arrow G at a predetermined rotational ratio with respect to the idle gear 43.

The idle gear 43 is engaged with the gear 42 provided at one end of the shaft of the screw 24*a*, and the gear 42 is directly engaged with a gear 41 provided at one end of the shaft of the screw 24*b*. Accordingly, by the rotation of the idle gear 43, the shaft of the screw 24*a* rotates in the direction shown by an arrow H, and the shaft of the screw 24*b* rotates in the direction shown by an arrow I. Namely, these two shafts rotate in directions opposite to each other at a predetermined rotational ratio. The developer is transported in the opposite direction to each other by this rotation, since the direction of the lead of the screw 24*a* is the same as that of the screw 24*b*.

A gear 46 is provided at the other end of the shaft of the screw 24*a*, as shown in FIGS. 3 and 4. The gear 46 engages the gear 45 provided on the rotation shaft 210 of the hopper 21, serving as a worm gear. Thus, the stirring blade 211 of the hopper 21 rotates simultaneously with the rotation of the shaft of the screw 24*a*. Also, at the time of supplying the developer, as described above, the stirring blade 812 of the developer refill container 800 rotates simultaneously with the rotation of the stirring blade 211 of the hopper 21.

When driven as described above, the developer in the hopper 21 is fed into the forward path 22*a* by the screw 24*a*, while being stirred by the stirring blade 211. The developer thus fed into the forward path 22*a* is always supplied to the recovering roller 25 and the photosensitive body 1 opposed to the forward path 22*a* through the developer supply opening 221. After the developing place 23, facing the recovering roller 25 and the photosensitive body 1, is filled with the developer, an extra portion of the developer is continuously forwarded by the screw 24*a*, and fed into the backward path 22*b* through the connecting path 22*c* located opposite to the hopper 21. Thereafter, the developer is transported in the backward path 22*b* in the direction opposite to that of the developer supply path 22*a*, and returns to the hopper 21 again.

In this way, the developer circulating in the developer transporting pipe 22 returns to the hopper 21 at each circulation and is mixed with the developer contained in the hopper 21. Consequently, the developer can be supplied in a .homogeneous state at all times. That is, the developer which is returned to the hopper 21 is mixed with the developer contained in the hopper 21 so as to have a homogeneous quality and the mixed developer is used for subsequent development. Because of this advantage, there is no possibility that a part of the developer rapidly deteriorates due to repeated use. In addition, repeatedly used developer is uniformly dispersed in the developer contained in the hopper 21. Thus, stable development is ensured.

(3) Cleaner 3

As shown in FIGS. 1 and 9, the cleaner 3 has a cleaning blade 31 contacting the surface of the photosensitive body 1. The cleaning blade 31 removes the residual developer after transfer operation from the surface of the photosensitive body 1. The cleaner 3 also has a seal 32 for sealing the developer which is subject to cleaning and gathered. The cleaner 3 has a developer restoring path 33 extending in parallel with the axial direction of the photosensitive body 1. In the developer restoring path 33, a screw 34 for transporting the developer is provided adjacent to a side wall. Since the amount of developer transported by the screw 34 is extremely small, a simple structure using a coil spring or the like is adaptable for the screw 34. The screw 34 is connected to the drive mechanism 4. As shown in FIG. 7, one end of the developer restoring path 33 is connected to the hopper 21, and the developer transported by the screw 34 is restored in the hopper 21.

In the cleaner 3 having the above-mentioned structure, the developer recovered by the cleaning blade 31 is gathered to the developer restoring path 33, sequentially transported by the screw 34 driven for rotation in conjunction with the photosensitive body 1 and the like, and then restored in the hopper 21.

In this way, according to the present invention, a space for accommodating the residual developer gathered by the cleaner 3 is unnecessary, and this is effective for realizing a small-sized apparatus. Further, it is possible to effectively consume the developer in a simplified apparatus, since the troublesome process such as discarding the gathered residual developer is not required.

(4) Drive mechanism 4

The drive mechanism 4 includes a motor (not shown). This motor drives and rotates the stirring blade 211 in the hopper 21, the screws 24*a* and the screw 24*b* in the developer transporting pipe 22, and the recovering roller 25, in addition to the photosensitive body 1, the transfer roller 500 and a heat roller 610 in the fixing device 600.

(Charger 300)

The type of the charger 300 is not particularly limited. The present invention employs a corona charger.

(Printer head 400)

As for the printer head 400, a solid image scanning method, in which an image exposure is performed by arranging light emitting elements (LED) or liquid crystal shutters, can be used. For example, a laser scanner which does not use mechanical scanning is used. However, in the case of a large-sized apparatus, a printer head which performs scanning by deflecting a laser beam can be used.

(Transfer roller 500)

The transfer roller 500 is located on the side where the paper supply slit 101 and the like is located, with respect to the photosensitive body 1. The transfer roller 500 is always pressed so as to be in contact with the photosensitive body 1 so that a bias voltage for transfer is applied, if required. The transfer roller 500 rotates in the direction shown by an arrow J as shown in FIG. 1.

(Fixing device 600)

The fixing device 600 has a heat roller 610 having a shaft which is in parallel with that of the photosensitive body 1. A rotation roller 620 is provided opposed to the heat roller 610. The recording paper 700 after the transfer operation is fed between the heat roller 610 and the rotation roller 620 via the transporting path 103. The heat roller 620 is rotated in the direction shown by an arrow K by the drive mechanism 4, as shown in FIG. 1.

The fixing device 600 is provided in a position which is sway from the photosensitive body 1, close to the paper discharge slit 104, end between the paper discharge slit 104 and the transfer section. That is, the fixing device 600 is always located above the photosensitive body 1, irrespective of whether the plane 120 or the plane 130 is selected for placing. In this way, the heat of the fixing device 600 does not influence the image forming section around the photosensitive body 1.

(Control circuit 900)

Figure 10:
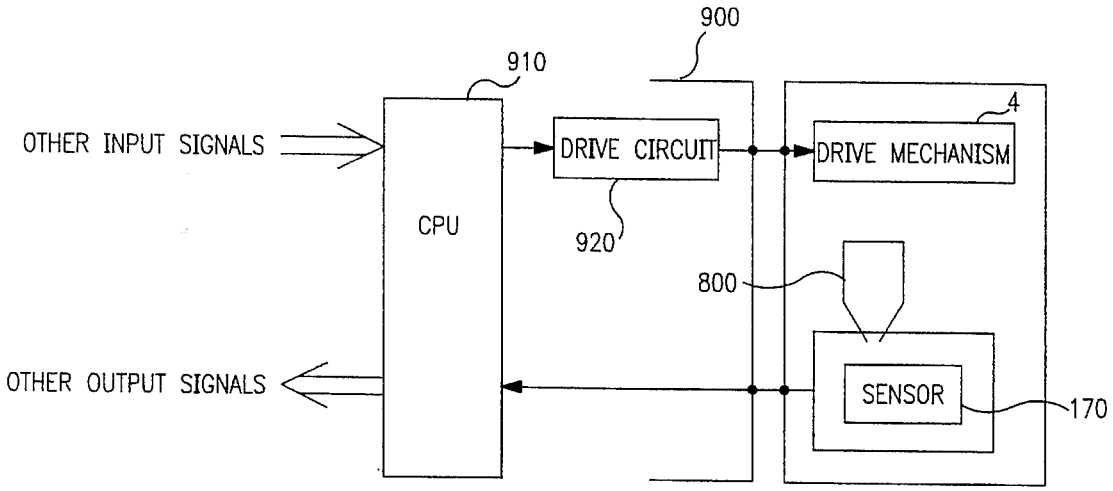
FIG. 10 is a block view of a control circuit of the image forming apparatus of FIG. 1.

FIG. 10 is a block diagram of the control circuit 900 of the present example.

The control circuit 900 which is provided on the case 100 or the developing device 2 has a CPU 910 and a drive circuit 920 for driving the drive mechanism 4. An output signal from the developer refill container detecting sensor 170 is input to the CPU 910.

The control operation at the time of refilling the developer will be described hereinafter.

When the developer refill container detecting sensor 170 detects that the developer refill container 800 is attached to the hopper 21, an output signal indicating the attachment is input to the CPU 910. Upon receiving the signal indicating the attachment, the CPU 910 supplies a command to the drive circuit 920 so that the drive mechanism 4 stops its operation after having worked for a predetermined period of time.

When the developer refill container 800 is attached to the hopper 21 for supplying the developer, the drive mechanism 4 is actuated simultaneously with the attachment of the developer refill container 800, and then the screws 24*a* and 24*b* are driven. As a result, the stirring blade 211 of the hopper 21 and the stirring blade 812 in the developer refill container 800 rotate simultaneously.

The predetermined period of time for driving the drive mechanism 4 is set so as to be long enough for the developer in the hopper 21 to reach the far end of the developer supply opening 221 in the forward path 22*a* facing the photosensitive body 1. Also, if this predetermined period of time is set to be equal to or longer than the time required for the developer from the hopper 21 to be transported via the forward path 22*a* and the backward path 22*b* and returned to the hopper 21 again (i.e., the time required for the developer to complete at least one cycle of circulating through the developer transporting pipe 22), the whole range of the developer transporting pipe 22 is filled with the developer, and the developer supply to the photosensitive body 1 is stably performed when an image forming operation is started or resumed.

In the developer transporting pipe 22, the forward path 22*a* and the backward path 22*b* are located adjacent to each other along the photosensitive body 1, and the developer is supplied from the developer supply opening 221 to the developing place 23 in the state of the developer keeping in contact with the photosensitive body 1. In such an arrangement, the developer is supplied via the shortest route to the developing place 23. The standby time for starting or resuming the image formation is also shortened.

The drive of the screws 24*a* and 24*b*, accompanied by the above-mentioned developer supply, is also started by an operator's switch operation.

EXAMPLE 2

Figure 11:
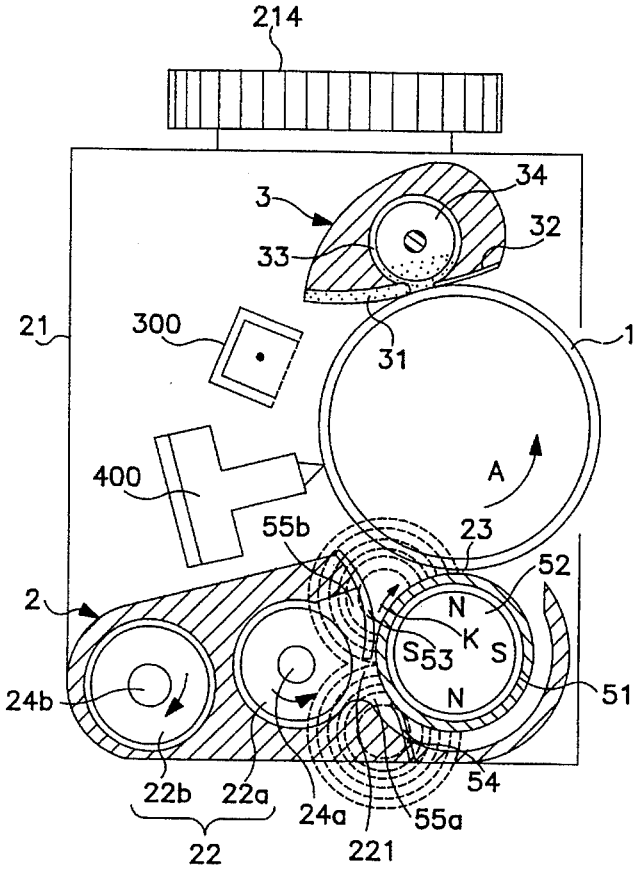
FIG. 11 is a cross-sectional view of an image forming unit of an image forming apparatus of Example 2 according to the present invention.
Figure 12:
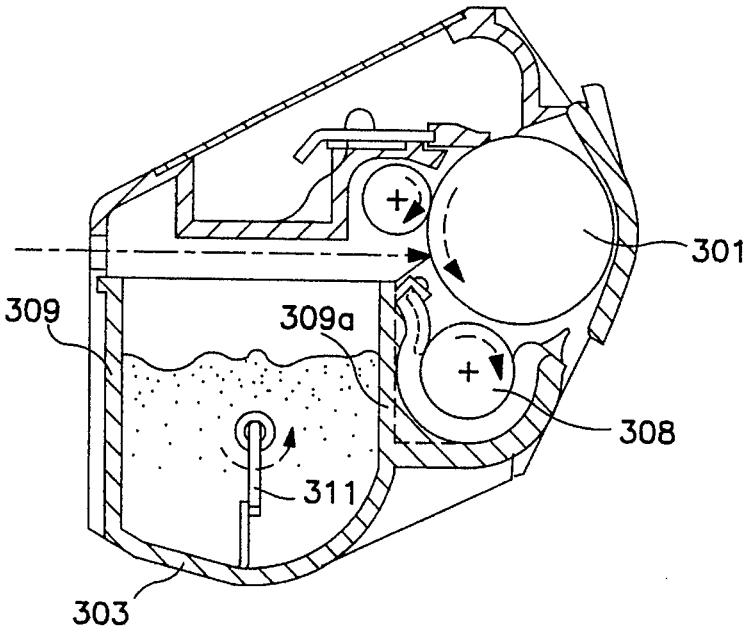
FIG. 12 is a cross-sectional view of a conventional image forming apparatus.
Figure 13:
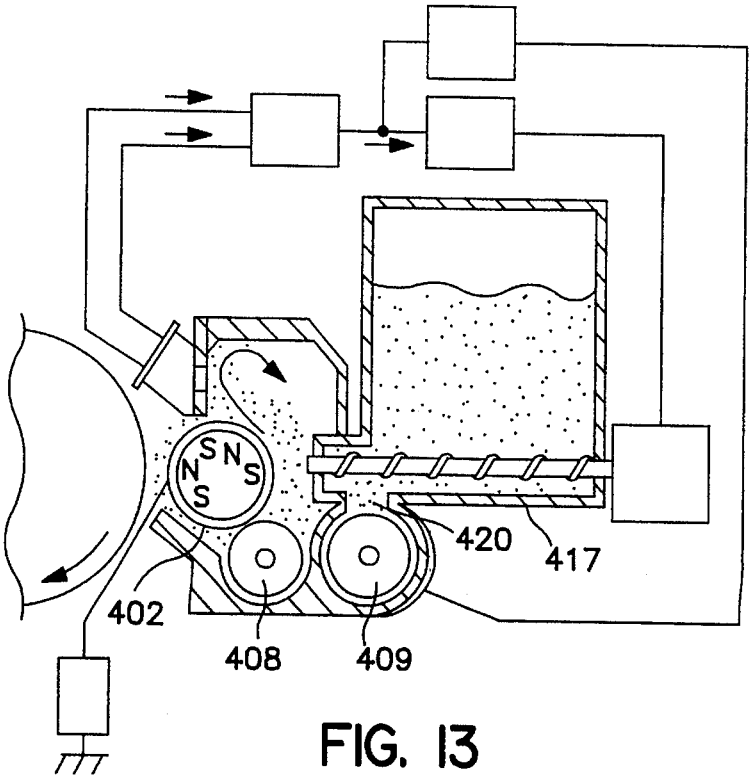
FIG. 13 is a cross-sectional view showing another conventional image forming apparatus.

An image forming apparatus of the second example according to the present invention will be described. FIG. 11 is a partially cross-sectional view showing the image forming apparatus of the present example. The second example differs from the first example only in developing method. The image forming apparatus of the second example has the same construction as that of first example, except for a developing device 2. Therefore, the description of elements identical to those in the first example will be omitted.

A developing device 2 of the present example will be described.

As shown in FIG. 11, the developing device 2 has a hopper 21 for accommodating and supplying a developer, a developer transporting pipe 22 for transporting the developer from the hopper 21, a developing sleeve 51, a magnet 52 disposed in the developing sleeve 51, an elastic blade 53, and a seal 54 for preventing the leakage of the developer. The developing sleeve 51, serving as a developer carrier, rotates in the direction of the arrow K. A thin layer of developer is formed on the surface of the developing sleeve 51 by the elastic blade 53.

The development of the thus constructed developing device 2 will be described.

The developer transported in a forward path 22*a* through a developer supply opening 221 is attracted by the magnet 52 and adhered to the surface of the developing sleeve 51. The developer thus supplied on the developing sleeve 51 is regulated by the elastic blade 53, and then a thin layer of developer is formed on the developer sleeve 51. In the developing place 23, the thin layer of developer is attracted only to an image area of an electrostatic latent image on a photosensitive body 1, whereby the latent image is developed.

A developer idle space in the forward path 22*a*, wherein the developer is not held by a screw 24*a*, is formed into two portions: a portion 55*a* where the developing sleeve 51 is opposed to the screw 24*a*, and a portion 55*b* where the screw 24*a* is opposed to the elastic blade 53. In this idle space including the portions 55*a* end 55*b*, a magnetic field is formed by the magnet 52. The magnetic developer in the portions 55*a* end 55*b* is held against the gravity, being restrained by the magnetic force that is at least stronger than the gravity. Therefore, even if an operator variously changes the direction of the apparatus, the developer in these portions 55*a* end 55*b* does not freely flow or thickly gather in one direction.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A developing device comprising:

hopper means for accommodating and supplying a developer;

developer carrier means for transporting the developer carried on a surface thereof to a developing place; and developer circulating means for circulating the developer between the hopper means and the developer carrier means;

wherein the developer circulating means includes a part of the hopper means and forward means and backward means both of which extend from the hopper means along the developer carrier means, the forward means and backward means respectively have spaces independent of each other, each of the spaces is defined by a wall, and in each of the spaces developer transporting means is provided for holding the developer therein and transporting the developer, the developer transporting means is arranged so that the periphery of the developer transporting means is adjacent to the corresponding wall of each space, thereby preventing the developer from flowing through the spaces of the forward means and the backward means when the developer is not being transported.

2. A developing device according to claim 1, wherein a developer transporting ability for feeding the developer from the hopper means to the forward means is larger than a developer transporting ability of the developer carrier means.

3. A developing device according to claim 1, wherein each of the developer transporting means includes a screw, and the screw located in the forward means extends in the hopper means.

4. A developing device according to claim 1, wherein the developer transporting means of the forward means does not reach a connecting portion for connecting one end of the forward means to one end of the backward means, and the developer transporting means of the backward means reaches the connecting portion.

5. A developing device comprising:

hopper means for accommodating and supplying a developer;

developer carrier means for transporting the developer carried on a surface thereof to a developing place; and developer circulating means for circulating the developer between the hopper means and the developer carrier means;

wherein the developer circulating means includes a part of the hopper means and forward means and backward means both of which extend from the hopper means along the developer carrier means, the forward means and backward means respectively have spaces independent of each other, and in each of the spaces developer transporting means is provided for holding the developer therein and transporting the developer, and wherein the developer includes a magnetic toner, the developing device further comprises magnetic field forming means for forming a magnetic field between the developer circulating means and the developing place, and the magnetic field is strong enough to cause a magnetic force at least capable of holding the developer against the gravity.

6. A developing device according to claim 5, wherein the magnetic field formed by the magnetic field forming means reaches at least a space including the developer transporting means on the side of the developer carrier means.

7. A developing device according to claim 5, wherein the magnetic field forming means is a magnet for development located in the developer carrier means.

8. A developing device comprising:

hopper means for accommodating and supplying a developer;

developer carrier means for transporting the developer carried on a surface thereof to a developing place; and developer circulating means for circulating the developer between the hopper means and the developer carrier means;

wherein the developer circulating means includes a part of the hopper means and forward means and backward means both of which extend from the hopper means along the developer carrier means, the forward means and backward means respectively have spaces independent of each other, and in each of the spaces developer transporting means is provided for holding the developer therein and transporting the developer, and wherein:

the hopper means comprises a refill port to which a developer refill container for refilling the developer into the hopper means is attached, and stirring means, located in the hopper means, for stirring the developer in conjunction with the developer transporting means; and the developing device comprises control means for controlling the stirring means to stir the developer in the hopper means when the developer is refilled from the developer refill container, and for controlling the developer transporting means to transport the developer in the developer circulating means to a developer supply opening through which the developer is supplied from the developer circulating means to the developer carrier means.

9. A developing device according to claim 8, wherein the developer refill container comprises:

a stirring member therein; and a coupling portion for connecting a rotation axis of the stirring member and a rotation axis of the stirring means of the hopper means to each other by attaching the developer refill container to the refill port and for disconnecting the rotation axis of the stirring member and the rotation axis of the stirring means of the hopper means from each other by detaching the developer refill container from the refill port.

10. An image forming apparatus comprising:

a photosensitive body on a surface of which an electrostatic latent image is formed;

developing means for developing the electrostatic latent image, comprising:

hopper means for accommodating a developer and supplying the developer, located at one end of the photosensitive body in the longitudinal direction;

developer carrier means for transporting the developer carried on a surface thereof to a developing place;

developer circulating means, including a part of the hopper means, for circulating the developer bidirectionally between the hopper means and the developer carrier means;

cleaning means for removing a residual developer from the surface of the photosensitive body, the cleaning means being in contact with the surface of the photosensitive body; and residual developer restoring means for restoring all the residual developer removed by the cleaning means to the hopper means for re-transferring the residual developer to the developing place.

11. An image forming apparatus comprising:

a photosensitive body on a surface of which an electrostatic latent image is formed;

developing means for developing the electrostatic latent image, comprising:

hopper means for accommodating a developer and supplying the developer, located at one end of the photosensitive body in the longitudinal direction;

developer circulating means, including a part of the hopper means, for circulating the developer bidirectionally between the hopper means and a part of the surface of the photosensitive body, the part of the surface functioning as developer carrier means for transporting the developer carried on a surface thereof to a developing place;

cleaning means for removing a residual developer from the surface of the photosensitive body, the cleaning means being in contact with the surface of the photosensitive body; and residual developer restoring means for restoring all the residual developer removed by the cleaning means to the hopper means for re-transferring the residual developer to the developing place.

12. A developing device according to claim 1, wherein the developer carrier means is a photosensitive body.

* * * * *